US005509353A

United States Patent [19]

Aoki

[11] Patent Number: 5,509,353

[45] Date of Patent: Apr. 23, 1996

[54] DRUM CLEANING APPARATUS FOR PRINTING MACHINE

[75] Inventor: Hiroshi Aoki, Kawasaki, Japan

[73] Assignee: Shimizu Seisaku Kabushiki Kaisha, Tokyo, Japan

[21] Appl. No.: 342,574

[22] Filed: Nov. 21, 1994

[30] Foreign Application Priority Data

Jun. 8, 1994 [JP] Japan ..... 6-126192

[51] Int. Cl.[6] ..... B43L 19/00

[52] U.S. Cl. ..... 101/425; 15/256.6

[58] Field of Search ..... 101/425, 423, 101/424, 256.5, 256.51, 256.52, 256.6

[56] References Cited

U.S. PATENT DOCUMENTS

| | | | |
|---|---|---|---|
| 4,197,138 | 4/1980 | Swiffen et al. | 134/6 |
| 4,757,763 | 7/1988 | MacPhee et al. | 101/425 |
| 4,981,078 | 1/1991 | Dettinger et al. | 101/425 |
| 4,991,507 | 2/1991 | Nozaka et al. | 101/425 |
| 5,117,754 | 6/1992 | Nozaka et al. | 101/425 |
| 5,125,342 | 6/1992 | Hara | 15/256.51 |
| 5,209,164 | 5/1993 | Durrnagel et al. | 101/425 |
| 5,275,104 | 1/1994 | Corrado et al. | 101/425 |
| 5,408,930 | 4/1995 | Loos | 101/425 |

*Primary Examiner*—Eugene H. Eickholt
*Attorney, Agent, or Firm*—Christopher R. Pastel; Thomas R. Morrison

[57] ABSTRACT

A cleaning head on a cassette of a drum cleaning apparatus is moved into contact with a drum to be cleaned. A cleaning sheet is moistened and passed between the drum and the cleaning head. The cleaning head is made of a resilient sponge-like material that evenly presses the cleaning sheet against the cylindrical drum during the cleaning operation. The cleaning sheet moves in a direction opposite to a rotation of the drum. The cassette body is removable from the frame to avoid interfering with printing.

5 Claims, 4 Drawing Sheets

DRUM CLEANING APPARATUS FOR PRINTING MACHINE

BACKGROUND

The present invention relates to a drum cleaning apparatus for cleaning drums of printing presses.

Printing presses are classified into three types: platen, cylinder, and rotary. Platen presses are the simplest. They are used for low volume operations. Platen presses essentially consist of two plates; one plate is the printing surface which holds the type, and the other plate is the impression surface which holds the paper. Cylinder presses are used in medium volume operations. They have a flat inked printing surface, but the impression surface is a cylinder. The printing surface rests on a bed that moves back and forth under the inking rollers. The impression cylinder rotates in coordination with motion of the printing surface. When the printing surface bed moves into contact with the impression cylinder, a print is produced. When the printing surface bed is out of contact with the impression cylinder, the printed sheet is removed and an unprinted sheet is positioned for the next cycle.

Rotary presses, which are used in high volume operations, use a cylindrical impression surface and a cylindrical printing surface. Both cylinders rotate in contact with each other as the paper passes between them to produce a print. The cylindrical printing surface (also known as a plate cylinder) is inked by ink rollers as the cylinder rotates.

While a printing press operates, paper fibers separate from the paper and adhere to the drum surface as do dried ink and other contaminants. After every press run, and periodically during a long press run, the cylindrical drums are cleaned of contaminants.

In the conventional type of drum cleaning apparatus for a printing press, as described in Japanese Utility Model Publication No. 36924/1992, a cleaning head made of a resilient material such as sponge presses a cleaning sheet against the surface of a drum in a printing press. The cleaning sheet is moved contrary to the rotational direction of the drum to rub and clean the surface of the drum of contaminants. The cleaning head is slender and rod-like along the axial direction of the drum. The cleaning head is attached to a supporting body which is moved against and away from the drum during the cleaning process.

In the conventional type of drum cleaning apparatus, however, used for cleaning the plate cylinder or impression cylinder of a rotary printing press used for printing newspapers, problems arise if the cylinder is too wide. If the cylinder width is increased to around 1.7m., the length of the cleaning head becomes correspondingly longer in proportion to its width with a concomitant increase in the normal stress of the cleaning head. The resulting deformation makes it difficult to press the cleaning sheet against the drum evenly and with an even pressure. Uneven cleaning is often the effect.

OBJECTS AND SUMMARY OF THE INVENTION

Accordingly, an object of this invention is to provide a drum cleaning apparatus for a printing press that overcomes the problems of the prior art.

It is a further object of this invention to resist the deforming stresses of the prior art and to clean a drum evenly and with an even pressure.

Briefly stated, a drum cleaning apparatus for cleaning a cylindrical drum of a printing press includes a cassette body mounted on a frame. When mounted on the frame, the cassette body is easily moved into contact with the cylindrical drum for cleaning. The cassette body includes a roll shaft, a cleaning head, a winding shaft, and means for impregnating a cleaning sheet as it passes through the cassette body. A portion of the cleaning sheet is impregnated with a cleaning fluid as it moves from the roll shaft, across the cleaning head, and onto the winding shaft. The cleaning head is made of a resilient sponge-like material that evenly presses the cleaning sheet against the cylindrical drum during the cleaning operation. The cleaning sheet moves in a direction opposite to the rotation of the drum. The cassette body is easily removed from the frame to enable changing the cleaning sheet or service the apparatus, and to ensure it does not interfere with printing operations.

According to an embodiment of the invention, a drum cleaning apparatus includes a cassette body including two cassette frames, one on either side of the cassette body, a roll shaft rotably attached between the cassette frames for providing a cleaning sheet, a cleaning head, means for suspending the cleaning head between the cassette frames, a winding shaft rotably attached between the cassette frames for winding up the cleaning sheet, means for moving the cleaning sheet from the roll shaft, across the cleaning head, and onto the winding shaft, and means for impregnating a portion of the cleaning sheet with a cleaning fluid while the cleaning sheet is between the roll shaft and the cleaning head.

According to a feature of the invention, the means for impregnating includes a member attached to the supporting body, the supporting body having a groove extending substantially throughout its length, the member having a liquid reservoir formed inside, means for providing a fluid to the groove, means for transferring the fluid from the groove to the liquid reservoir, the liquid reservoir having a plurality of holes in a bottom thereof for permitting the fluid to drip from the liquid reservoir, and a receiving tray attached between the cassette frames and aligned in parallel below the member and having a space between the receiving tray and the member for permitting the cleaning sheet to pass therebetween.

According to an embodiment of the invention, a drum cleaning apparatus includes a cassette body including two cassette frames on either side of the cassette body, a roll shaft rotably attached between the cassette frames for providing a cleaning sheet, a cleaning head, means for suspending the cleaning head between the cassette frames, a winding shaft rotably attached between the cassette flames for winding up the cleaning sheet, means for moving the cleaning sheet from the roll shaft, across the cleaning head, and onto the winding shaft, means for impregnating a portion of the cleaning sheet with a cleaning fluid while the cleaning sheet is between the roll shaft and the cleaning head, a left and right fixed frames for receiving the cassette body, and means for moving the cassette body forward and backward on the left and right fixed frames so that when the cassette body is moved forward it makes contact with the drum and when the cassette body is moved backward it moves out of contact with the drum.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT(S)

Figure 1:
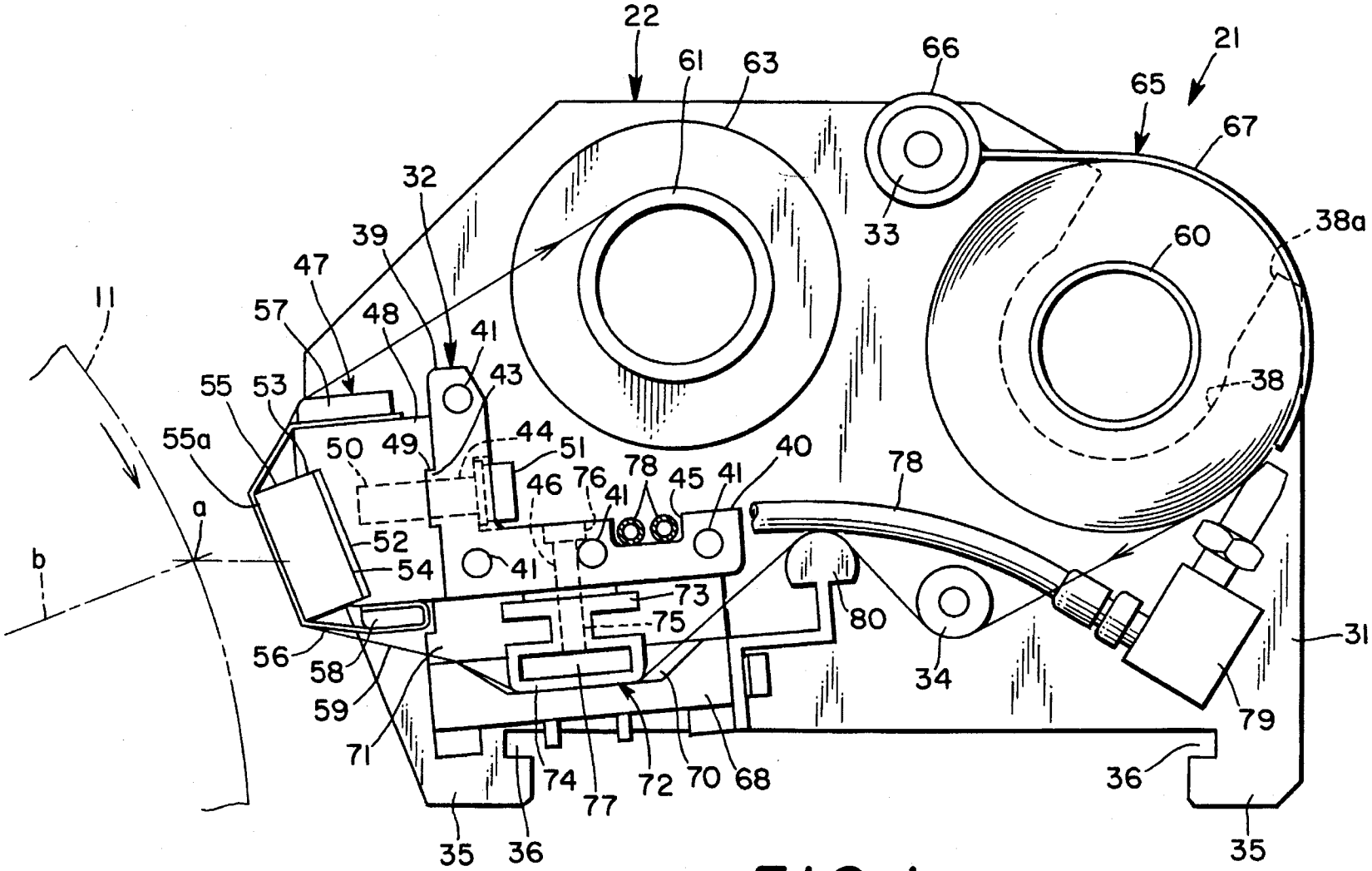
FIG. 1 is a side section view of an embodiment of the present invention.
Figure 3:
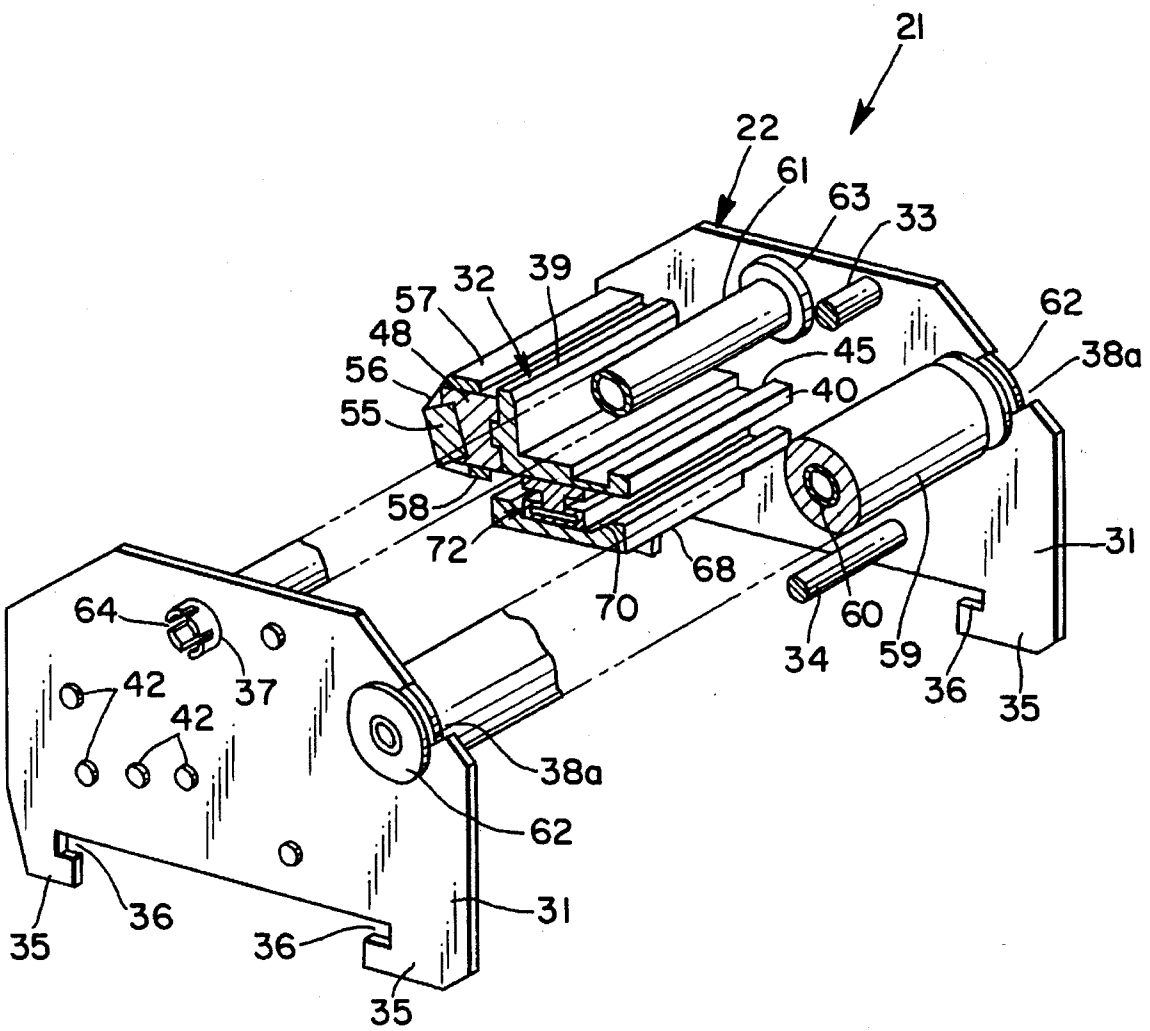
FIG. 3 is a fragmentary perspective view of a cassette body of an embodiment of the present invention.

Referring to FIGS. 1 and 3, a drum 11 is to be cleaned by a drum cleaning apparatus 21. A cassette body 22 of drum cleaning apparatus 21 moves forward into contact with drum 11 and backward out of contact. A supporting body 32 connects front portions of two cassette frames 31. An upper connecting shaft 33 and a lower connecting shaft 34 connect back portions of cassette flames 31 for added rigidity. A pair of sheet guiding members 65 are attached to upper connecting shaft 33. A roll shaft 60 turns on two wheels 62 which are mounted on cassette flames 31. Roll shaft 60 is designed to fit in a hole 38 in each cassette frame 31 through detaching groove 38*a* so it can be easily replaced. Each of sheet guiding members 65 holds an outside surface of a cleaning sheet 59 as it is unrolled from roll shaft 60. Each sheet guiding member 65 has a curved holding piece 67 attached to a mounting ring 66 which is rotably attached to upper connecting shaft 33.

A winding shaft 61 is held in place by two retaining rings 63 disposed on the insides of cassette frames 31. Winding shaft 61 penetrates cassette frames 31 through holes 37. Winding shaft 61 has a plurality of notches 64 on the portions outside cassette frames 31.

Supporting body 32, in addition to connecting the front portions of cassette frames 31, provides a framework for a receiving tray 68 and a head unit 47. Supporting body 32 is "L" shaped with a vertical section 39 and a horizontal section 40. A plurality of bolt holes 41 penetrate cassette frames 31 into horizontal section 40 and vertical section 30 for receiving fasteners such as bolts 42.

Vertical section 30 has a longitudinal convex section 43 corresponding to a concave section 49 of a base 48. Base 48 is attached to vertical section 39 by fasteners such as bolts 51 which pass through a plurality of mounting holes 44 in convex section 43 and a plurality of bolt holes 50 in concave section 49. Base 48 has a concave section 53 on a front face for receiving a cleaning head 55. Concave section 53 is inclined so that cleaning sheet 59 makes contact with drum 11 substantially perpendicular to a radius b. Cleaning head 55 is made of sponge or other resilient sponge-like material and is attached to a mounting surface 52 by a double-sided adhesive tape 54 for easy replacement. A film 56, which is made of a fluorine compound having characteristics such as non-adhesiveness, low friction, resistance against wearing, and chemical stability, covers all of a face 55*a* of cleaning head 55. Film 56 is held in place by two holding members 57 and 58 which are in turn fixed to base 48.

Horizontal section 40 connects to a mounting section 73 of a member 72 by fasteners such as bolts 76 which pass through a plurality of mounting holes 46 in horizontal section 40 and a plurality of bolt holes 75 in mounting section 73. Member 72 also includes a guiding member 74 which has a liquid reservoir 77 formed inside. Guiding member 74 has a quantity of small holes (not shown) disposed throughout so that a cleaning fluid (not shown) in liquid reservoir 77 drips onto cleaning sheet 59. A plurality of mounting members 71 attach receiving tray 68 to member 72 and horizontal section 40 near cassette frames 31. Receiving tray 68 has a concave section 70 that is shaped to retain cleaning fluid while cleaning sheet 59 passes between receiving tray 68 and guiding member 74. Receiving tray 68 prevents excess cleaning fluid from spilling out of cassette body 22 during operation.

Horizontal section 40 also has a groove 45 running its length for receiving supply tubes 78 which carry cleaning fluid from a source (not shown), through a coupler 79, along the inside of cassette frame 31, and into groove 45. A supply hole (not shown) in horizontal section 40 aligns with an intake hole (not shown) in mounting section 73 so that cleaning fluid passed from supply tube 78 to liquid reservoir 77.

Each cassette frame 31 has two mounting pieces 35 on the lower side. Each mounting piece 35 has a mounting notch 36 cut therein.

Figure 2:
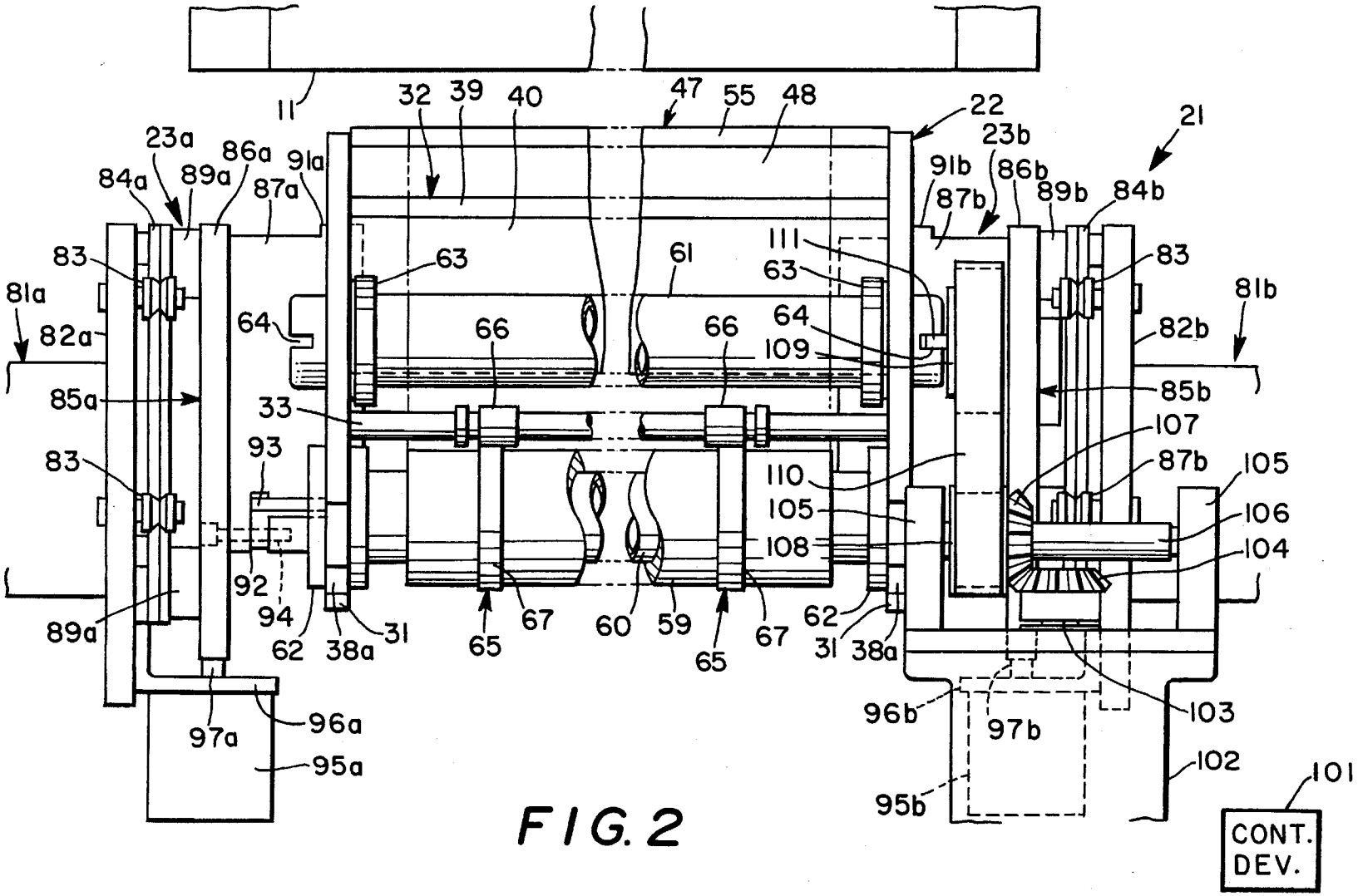
FIG. 2 is top section view of an embodiment of the present invention.
Figure 4B:
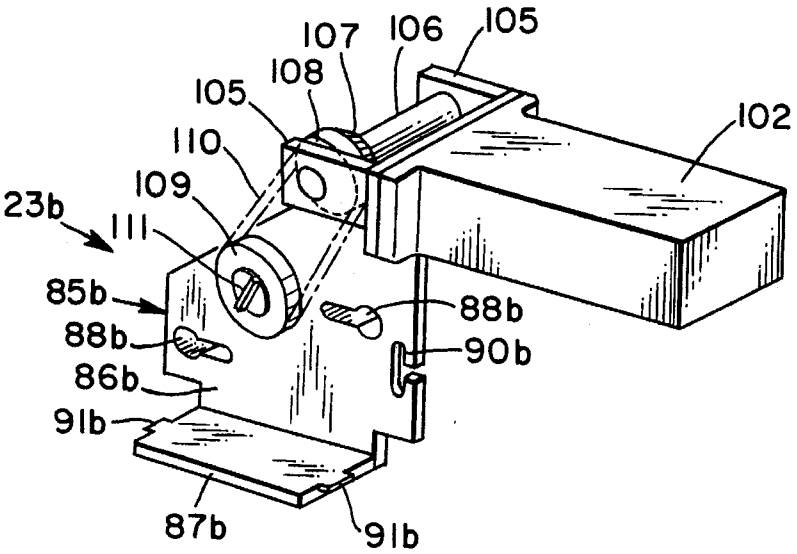
FIG. 4*b* is a perspective view of a driving mechanism of an embodiment of the present invention.
Figure 4A:
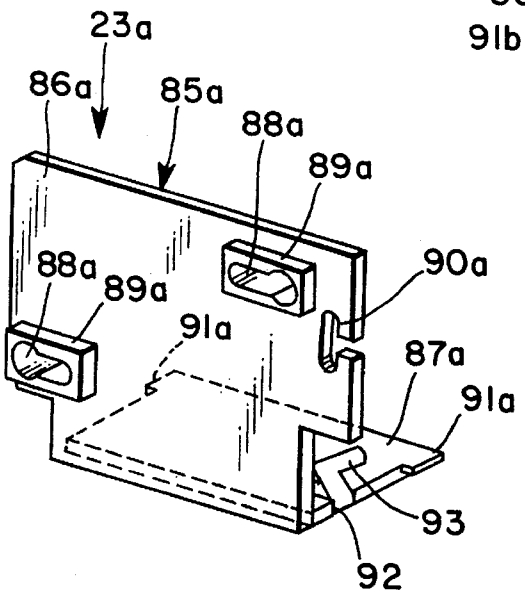
FIG. 4*a* is a perspective view of a mounting mechanism of an embodiment of the present invention.

Referring to FIGS. 2 and 4*a*–4*b*, a driving mechanism 23*b* is mounted on a fixed frame 81*b* on a right side of drum cleaning apparatus 21. A mounting mechanism 23*a* is mounted on a fixed frame 81*a* on a left side of drum cleaning apparatus 21. Fixed flames 81*a*, 81*b* are horizontal and rest on a floor surface (not shown). Two vertical fixed plates 82*a*, 82*b* are integrally connected to their respective fixed flames 81*a*, 81*b*, and each of fixed plates 82*a*, 82*b* supports four rollers 83. Rollers 83 are disposed at the corners of a rectangle such that the rollers guide and support slide plates 84*a*, 84*b* on their top and bottom. Each roller 83 has a "V" cross-section which matches angled edges of two slide plates 84*a*, 84*b*. Slide plates 84*a*, 84*b* thus are capable of moving forward and backward guided by rollers 83.

Two slide frames 85*a*, 85*b* consist of respective vertical supporting plates 86*a*, 86*b*. Cassette receiving plates 87*a*, 87*b*, are connected to respective slide plates 84*a*, 84*b* by fasteners (not shown) that pass through mounting holes 88*a*, 88*b* inside mounts 89*a*, 89*b* of vertical supporting plates 86*a*, 86*b*. Each cassette receiving plate 87*a*, 87*b* has a projecting section 91*a*, 91*b* at front and rear edges that correspond to mounting notches 36 on cassette frames 31. Cassette receiving plate 87*a* has a groove section 92 on its rear edge with a stopper 93 rotably attached with a fastener such as a bolt 94. When cassette body 22 is mounted on cassette receiving plates 87*a*, 87*b*, stopper 93 is rotated upward to prevent lateral movement.

Two connection grooves 90*a*, 90*b* (FIGS. 4*a*–4*b*) are located on a rear edge of vertical supporting plates 86*a*, 86*b*. Fixed frames 81*a*, 81*b* have respective "L" shaped brackets 96*a*, 96*b* at a rear end which support respective air cylinders 95*a*, 95*b*. Air cylinders 95*a*, 95*b* have respective rods 97*a*, 97*b* which engage respective connection grooves 90*a*, 90*b*. Air cylinders 95*a*, 95*b* move cassette body 22 forward into contact with drum 11 and backward out of contact.

Driving mechanism 23*b* includes a key 111 which engages notch 64 to rotate winding shaft 61. Key 111 is connected to a driven pulley 109 which in turn is connected to a driving pulley 108 by a belt 110 reeved over driving pulley 108 and driven pulley 109. Driving pulley 108 is mounted on a rotating shaft 106 which is held in place by two blocks 105. A bevel gear 107 on rotating shaft 106 engages a bevel gear 104 on a rotating shaft 103. Rotating shaft 103 is driven by a motor 102. Driving mechanism 23*b* thus rotates winding shaft 61.

Cassette body 22 can be removed from slide frames 85*a*, 85*b* by rotating stopper 93 downwards below cassette receiving plate 87*a*. Cassette body 22 is moved leftward until mounting notches 36 (FIG. 3) disengage projecting sections 91*a*, 91*b* and notch 64 on winding shaft 61 disengages key 111 on driving mechanism 23*b*. Cassette body 22 can then be lifted and moved away from slide frames 85*a*, 85*b*.

The reverse process is used to mount cassette body 22 to slide frames 85*a*, 85*b*. Once cassette body 22 is mounted on slide frames 85*a*, 85*b*, a control device 101 is used to control air cylinders 95*a*, 95*b* and motor 102. Control device 101 can also be used to control the flow of cleaning fluid into coupler 79. Air cylinders 95*a*, 95*b* move cleaning sheet 59 into contact with drum 11. Since cleaning head 55 is made of sponge or other resilient sponge-like material, it resiliently compresses. This resilience causes cleaning sheet 59 to press evenly against drum 11. Film 56 reduces the consequent friction on cleaning sheet 59.

Referring again to FIG. 1, cleaning Sheet 59 contacts drum 11 at a contact position a as drum 11 rotates in the direction shown by the arrow. Cleaning sheet 59 is pulled from roll Shaft 60, passes under lower connecting shaft 34, over guide member 80, and under guiding member 74. As cleaning sheet 59 moves under guiding member 74, it is impregnated with a cleaning liquid from liquid reservoir 77 that drips through small holes (not shown) in guiding member 74. Cleaning sheet 59 then moves across face 55*a* of cleaning head 55 to make contact with drum 11. Cleaning sheet 59 continues across holding member 57 to winding shaft 61 where it is reeled.

Drum 11 is slowly rotated in the direction shown by an arrow while winding shaft 61 pulls cleaning sheet 59 in a direction opposite to the rotation of drum 11. Cleaning sheet 59 is impregnated with cleaning fluid before it makes contact with drum 11. After drum 11 is cleaned, the flow of cleaning fluid is stopped while winding shaft 61 continues to move cleaning sheet 59. As dry portions of cleaning sheet 59 come into contact with drum 11, any cleaning fluid remaining on drum 11 is absorbed and removed.

After drum 11 is cleaned, control device 101 moves cassette body 22 away from drum 11. Cassette body 22 can then be removed from slide frames 85*a*, 85*b* to prevent interference with normal printing operations.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A drum cleaning apparatus, comprising:

a cassette body;

first and second cassette frames on first and second sides of said cassette body;

a roll shaft;

said roll shaft being rotably attached between said first and second cassette frames;

a cleaning sheet on said roll shaft;

a cleaning head;

means for suspending said cleaning head between said first and second cassette frames facing said drum;

a winding shaft;

means for moving said cleaning sheet from said roll shaft, across said cleaning head, and onto said winding shaft;

means for impregnating a portion of said cleaning sheet with a cleaning fluid while said cleaning sheet is between said roll shaft and said cleaning head;

means for moving said cassette body toward said drum, whereby said cleaning sheet over said cleaning head contacts said drum;

said means for impregnating including a reservoir extending substantially between said first and second cassette frames;

means for feeding a cleaning fluid to said reservoir;

said cleaning sheet passing below said reservoir;

means for transferring said fluid from said reservoir to said cleaning sheet;

a receiving tray below said reservoir; and a space between said reservoir and said receiving tray for permitting said cleaning sheet to pass therebetween.

2. A drum cleaning apparatus according to claim 1, wherein said means for moving said cleaning sheet comprises:

a motor;

a rotating shaft gearingly engaged with said motor;

a driving pulley on said rotating shaft;

a driven pulley;

a belt reeved over said driving pulley and said driven pulley; and means for engaging said driven pulley with said winding shaft.

3. A drum cleaning apparatus according to claim 1, wherein said cleaning head includes a resilient sponge-like material.

4. A drum cleaning apparatus according to claim 1, wherein said cleaning head includes a film having low-friction characteristics.

5. A drum cleaning apparatus according to claim 4, wherein said film is of a fluorine compound.

* * * * *